US009382748B2

(12) United States Patent
Manzella et al.

(10) Patent No.: US 9,382,748 B2
(45) Date of Patent: Jul. 5, 2016

(54) INTERMEDIATE MEMBER FOR EXTENDING THE DEPTH OF A WINDOW OR DOOR AND WINDOW OR DOOR CONSTRUCTED WITH SAME

(71) Applicant: Francis Manzella, Rockville Centre, NY (US)

(72) Inventors: Francis Manzella, Rockville Centre, NY (US); John G. Kirchner, Smithtown, NY (US); David Zhang, Edwardsville, IL (US); Robert Diamond, Babylon, NY (US)

(73) Assignee: Francis Manzella, Rockville Centre, NY (US)

( * ) Notice: Subject to any disclaimer, the term of this patent is extended or adjusted under 35 U.S.C. 154(b) by 0 days.

(21) Appl. No.: 14/252,227

(22) Filed: Apr. 14, 2014

(65) Prior Publication Data

US 2014/0311041 A1 Oct. 23, 2014

Related U.S. Application Data

(60) Provisional application No. 61/812,899, filed on Apr. 17, 2013.

(51) Int. Cl.

| | |
|---|---|
| ***E06B 3/26*** | (2006.01) |
| ***E06B 3/42*** | (2006.01) |
| ***E06B 3/44*** | (2006.01) |
| ***E06B 1/30*** | (2006.01) |
| ***E06B 1/70*** | (2006.01) |
| ***E06B 3/22*** | (2006.01) |
| *E06B 3/08* | (2006.01) |

(52) U.S. Cl.

CPC ..... *E06B 3/2605* (2013.01); *E06B 1/30* (2013.01); *E06B 1/702* (2013.01); *E06B 3/22* (2013.01); *E06B 3/42* (2013.01); *E06B 3/44* (2013.01); *E06B 3/4415* (2013.01); *E06B 3/08* (2013.01)

(58) Field of Classification Search

CPC ..... E06B 3/42; E06B 3/44; E06B 3/4415; E06B 1/702; E06B 3/2605; E06B 1/30

See application file for complete search history.

(56) References Cited

U.S. PATENT DOCUMENTS

| | | | | |
|---|---|---|---|---|
| 2,250,723 | A * | 7/1941 | Peremi et al. | 49/436 |
| 4,510,713 | A * | 4/1985 | Anderson | 49/175 |
| 4,682,451 | A * | 7/1987 | Hubble | 52/97 |
| 7,065,929 | B2 * | 6/2006 | Manzella et al. | 52/204.1 |
| 7,987,633 | B2 * | 8/2011 | Lenox et al. | 49/504 |
| 8,112,941 | B2 * | 2/2012 | Lenox et al. | 49/501 |
| 2005/0055908 | A1 * | 3/2005 | Manzella et al. | 52/204.5 |
| 2011/0283625 | A1 * | 11/2011 | Lenox et al. | 49/425 |

FOREIGN PATENT DOCUMENTS

DE 29705215 U1 * 5/1997

* cited by examiner

*Primary Examiner* — Katherine Mitchell
*Assistant Examiner* — Marcus Menezes
(74) *Attorney, Agent, or Firm* — McNeely, Hare & War LLP; Kevin J. McNeely

(57) ABSTRACT

A window or door is constructed to accept one or more intermediate pieces which may be used for adjusting the depth of the window or door. The intermediate piece includes, on one side, a first hook and an outrigger, and on the other side, a second hook and structure defining an outrigger receiving slot. The intermediate pieces lockingly and securely mate with the interior and exterior sections of the windows or doors.

19 Claims, 12 Drawing Sheets

INTERMEDIATE MEMBER FOR EXTENDING THE DEPTH OF A WINDOW OR DOOR AND WINDOW OR DOOR CONSTRUCTED WITH SAME

CROSS-REFERENCE TO RELATED APPLICATIONS

This application is related to U.S. Provisional Application Ser. No. 61/812,899, filed on Apr. 17, 2013, and entitled "Window Structured To Accept One Or More Intermediate Sections For Adjusting The Depth Thereof", the disclosure of which is incorporated herein by reference and on which priority is hereby claimed.

BACKGROUND OF THE INVENTION

1. Field of the Invention

The present invention generally relates to windows, but is applicable to doors, as well, and more specifically relates to window and door assemblies, including the construction of fixed, double hung, sliding, tilt and turn and casement windows, and sliding and French doors, for example.

2. Description of the Prior Art

Most conventional windows and doors are typically constructed from one-piece extruded components. The jambs, head and sill of the window or door frame, and the stiles and rails forming the window sash, whether fixed or moveable, are each conventionally formed as a single extruded part which is then assembled with the other parts to form the frame or sash.

The depth of the window or door is determined by the depth of the housing frame in which the window or door is mounted. This constraint requires that the windows and doors be constructed to fit appropriately within the framed-out opening of the building. For example, some housing constructions are formed with six inch wide studs on their exterior walls to accommodate thicker insulation. Older constructions generally have four inch exterior walls. Thus, windows and doors need to be ordered with selected depths to fit the exterior walls, and interior walls, of the building in which they are to be mounted. This requires a greater inventory of doors and windows having different depths by the manufacturer to meet the requirements of the building industry.

OBJECTS AND SUMMARY OF THE INVENTION

It is an object of the present invention to provide a window, or door, construction that allows the depth of the window, or door, to be adjusted easily.

It is another object of the present invention to provide a window, or door, construction by which the depth of the window, or door, may be adjusted at the job site.

It is yet another object of the present invention to provide a window, or door, construction which is adapted to receive one or more intermediate sections or pieces for adjusting the depth of the window or door.

It is yet a further object of the present invention to provide a window or door which overcomes the inherent disadvantages of conventional windows and doors.

In accordance with one form of the present invention, a window or door is constructed to accept one or more intermediate sections or pieces which may be used for adjusting the depth of window or door. For example, the jambs, head and sill of the window or door frame, and the stiles and rails forming the window sash, are constructed from an interior section, and an exterior section which is coupled to the interior section using a coupling, such as disclosed in U.S. Pat. No. 7,065,929 (Manzella, et al.). In accordance with the invention, one or more intermediate, extension pieces or sections may be interposed between, and coupled to, the interior section and exterior section of the window or door, to extend the depth of the door, as required by the depth of the framed-out openings of the building in which the windows and doors are to be mounted.

The intermediate piece or section, or pieces or sections, are constructed to lockingly and securely mate with the interior and exterior sections of the windows or doors. Each intermediate, depth-extending piece includes, on one side, a first hook and an outrigger, and on the other side, a second hook and structure defining an outrigger receiving slot. The first hook may be inwardly facing or outwardly facing, and the second hook is preferably disposed in an opposite direction to that of the first hook, that is, either outwardly facing or inwardly facing. The interior section of the window or door includes cooperating structure to mate with the intermediate, depth-extending piece, that is, a hook to either couple with the first hook or the second hook of the intermediate piece, and either an outrigger or structure to define an outrigger receiving slot, to couple with either the structure on the intermediate piece defining the outrigger receiving slot, or the outrigger of the intermediate piece, respectively. The exterior section of the window or door also includes structure, like the interior section of the window or door, which mates with the intermediate piece on the other side thereof, including a hook which mates with either the first hook or the second hook of the intermediate piece, and either structure defining an outrigger receiving slot to receive the outrigger of the intermediate piece, or an outrigger which is received by the outrigger receiving slot of the intermediate piece. Locking splines, wedges or the like are inserted between the intermediate piece and the exterior section and interior section of the window or door near where the first and second hooks of the intermediate piece engage the hooks of the exterior and interior sections of the window or door to prevent the disengagement of the hooks of the intermediate piece and the exterior and interior sections of the window or door and to maintain the intermediate piece, exterior section and interior section of the window or door as an assembled structure. Also, it should be realized that multiple intermediate pieces may be joined together and interposed between the interior and exterior sections of the window or door in order to adjust the thickness of the window or door to any desired depth.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
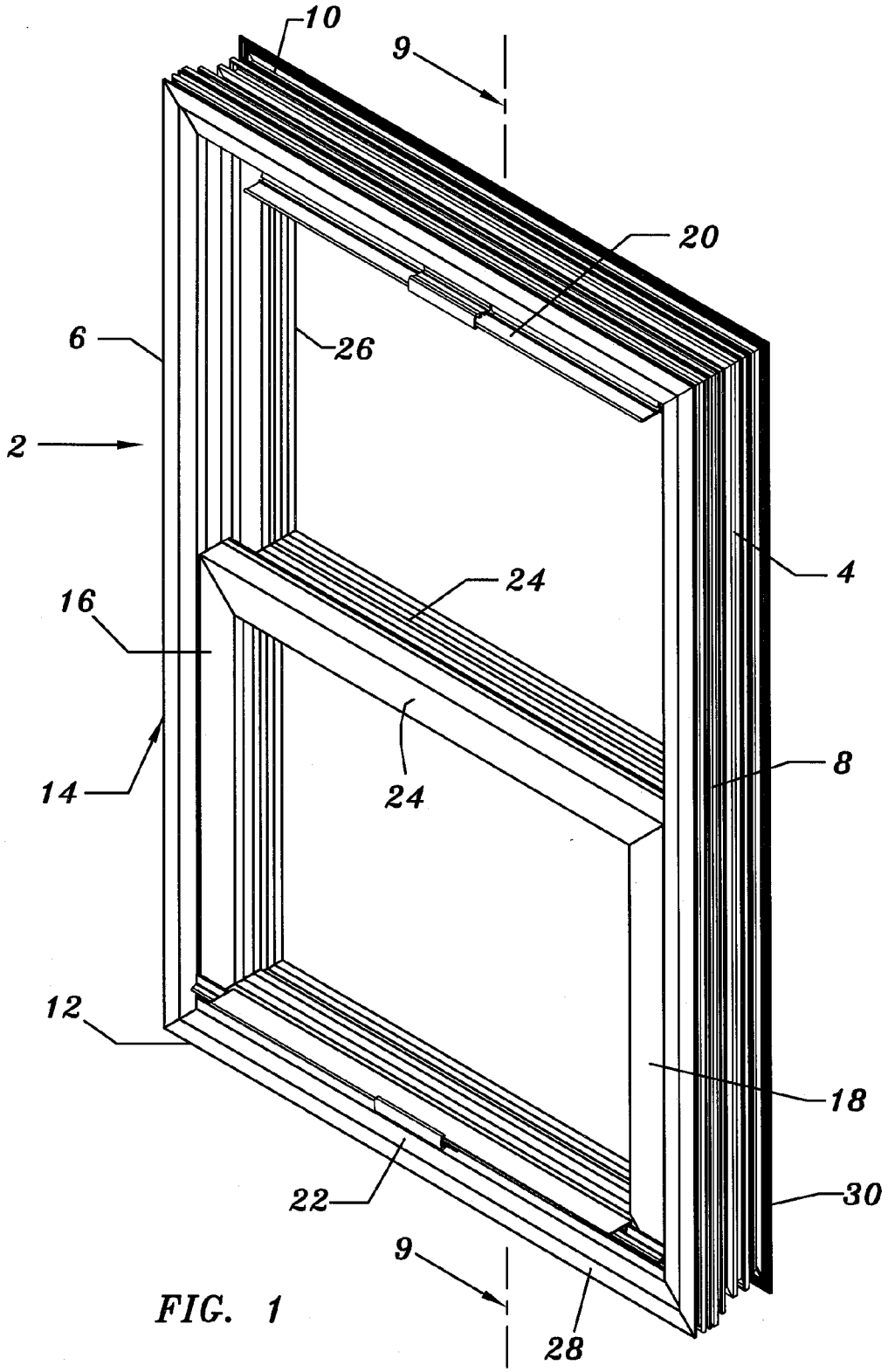
FIG. 1 is a perspective view of a double hung window formed in accordance with the present invention and having an overall depth which may be extended by inserting between the exterior section thereof and the interior section thereof one or more intermediate pieces.
Figure 2:
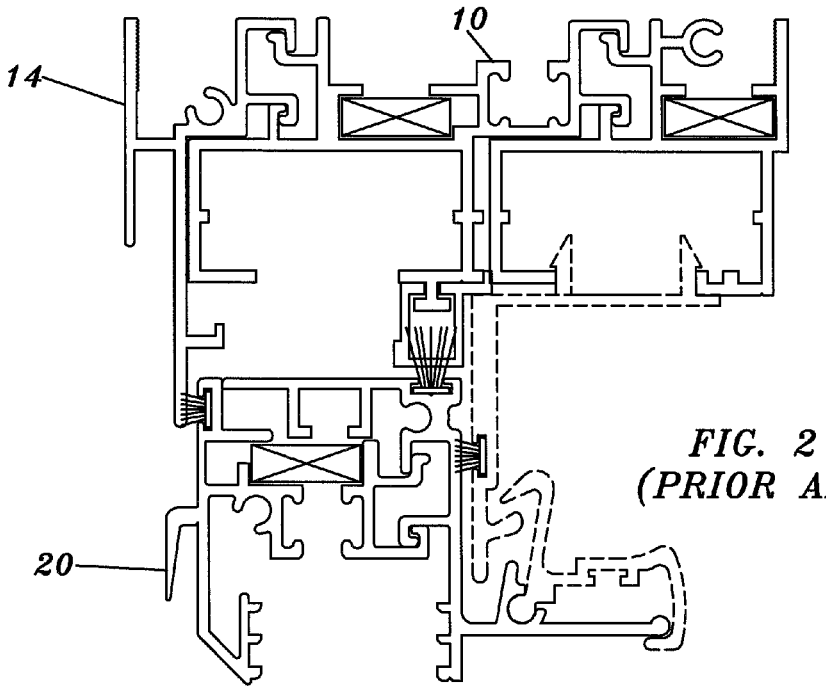
FIG. 2 (PRIOR ART)
FIG. 2 is a longitudinal, cross-sectional view of the head of a conventional, two-part, double hung window formed in accordance with the teachings of the aforementioned Manzella, et al. U.S. Pat. No. 7,065,929.
Figure 3:
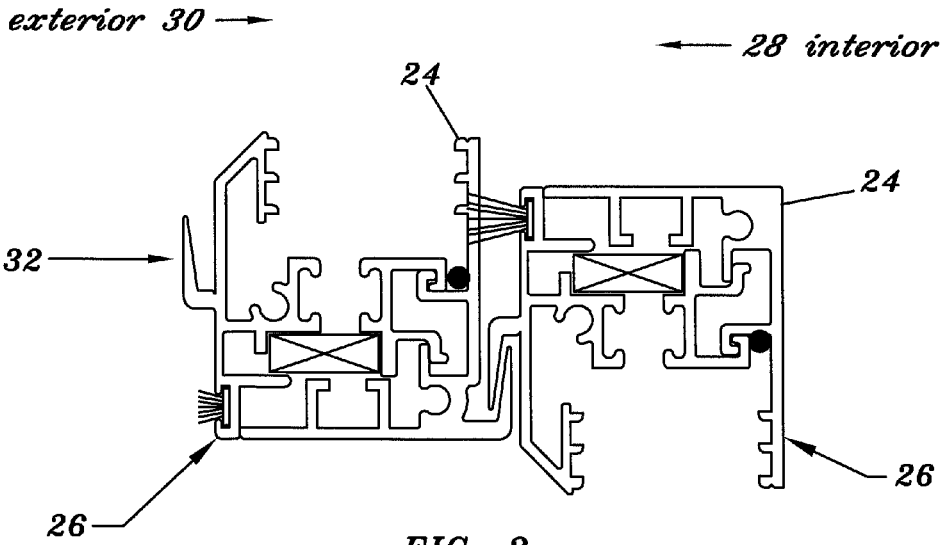
FIG. 3 (PRIOR ART)
FIG. 3 is a longitudinal, cross-sectional view of the meeting rail section of a conventional, two-part, double hung window formed in accordance with the teachings of the aforementioned Manzella, et al. U.S. Pat. No. 7,065,929.
Figure 4:
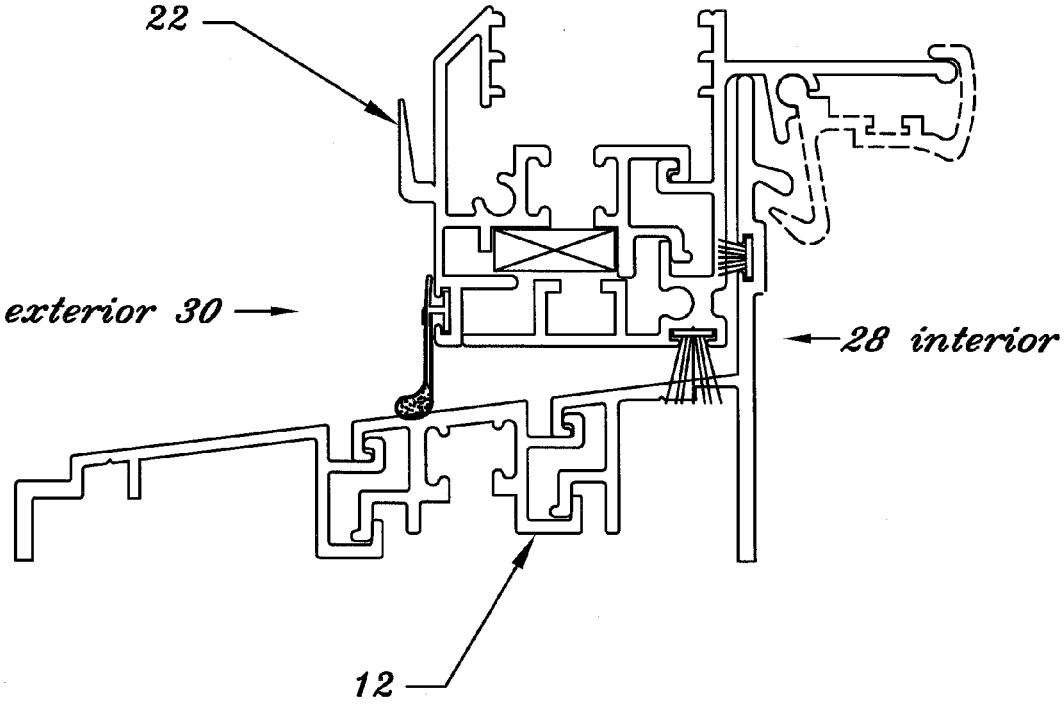
FIG. 4 (PRIOR ART)
FIG. 4 is a longitudinal, cross-sectional view of the sill of a conventional, two-part, double hung window formed in accordance with the teachings of the aforementioned Manzella, et al. U.S. Pat. No. 7,065,929.
Figure 5:
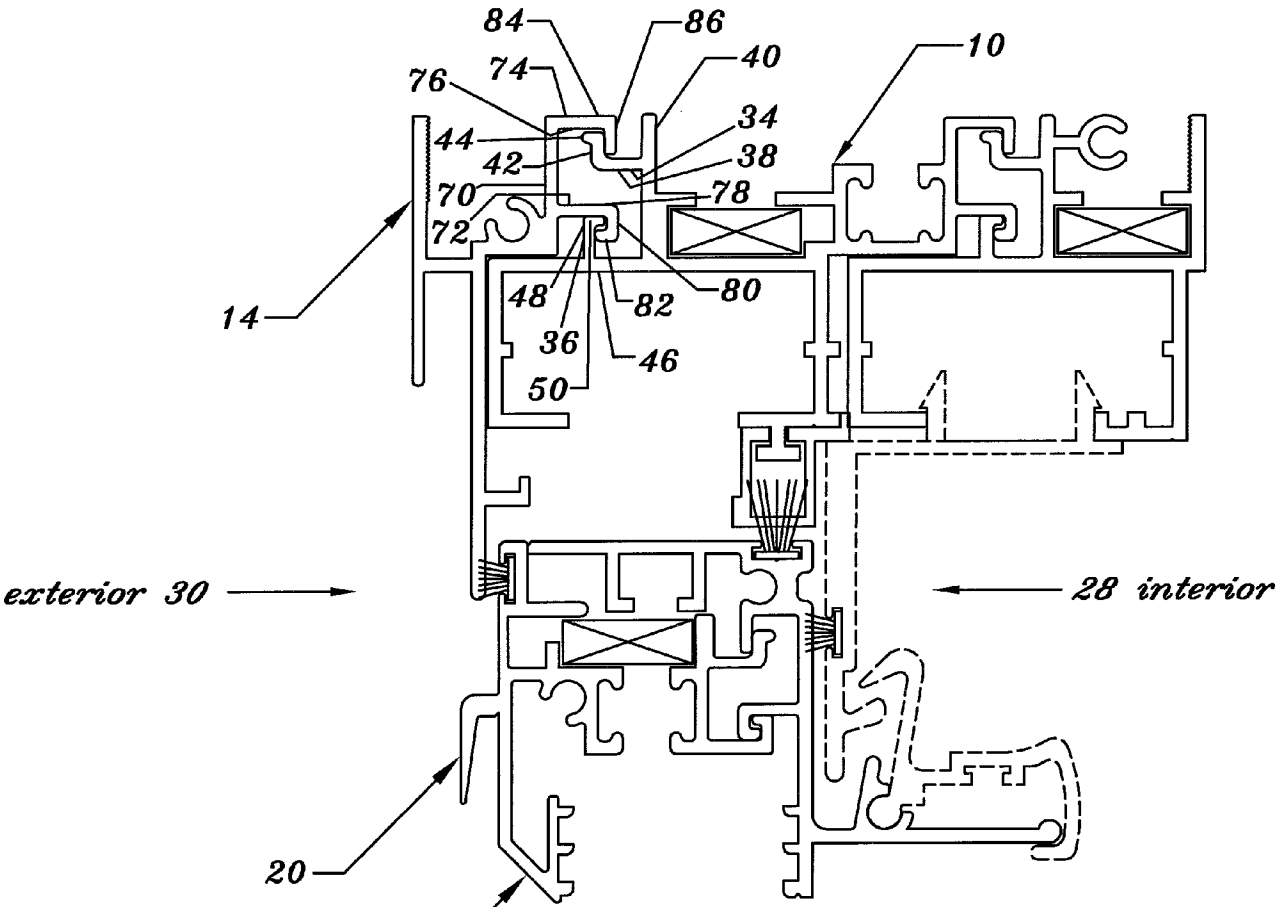
FIG. 5 (PRIOR ART)
FIG. 5 is an enlarged cross-sectional view of the head of the conventional window shown in FIG. 2.
Figure 6:
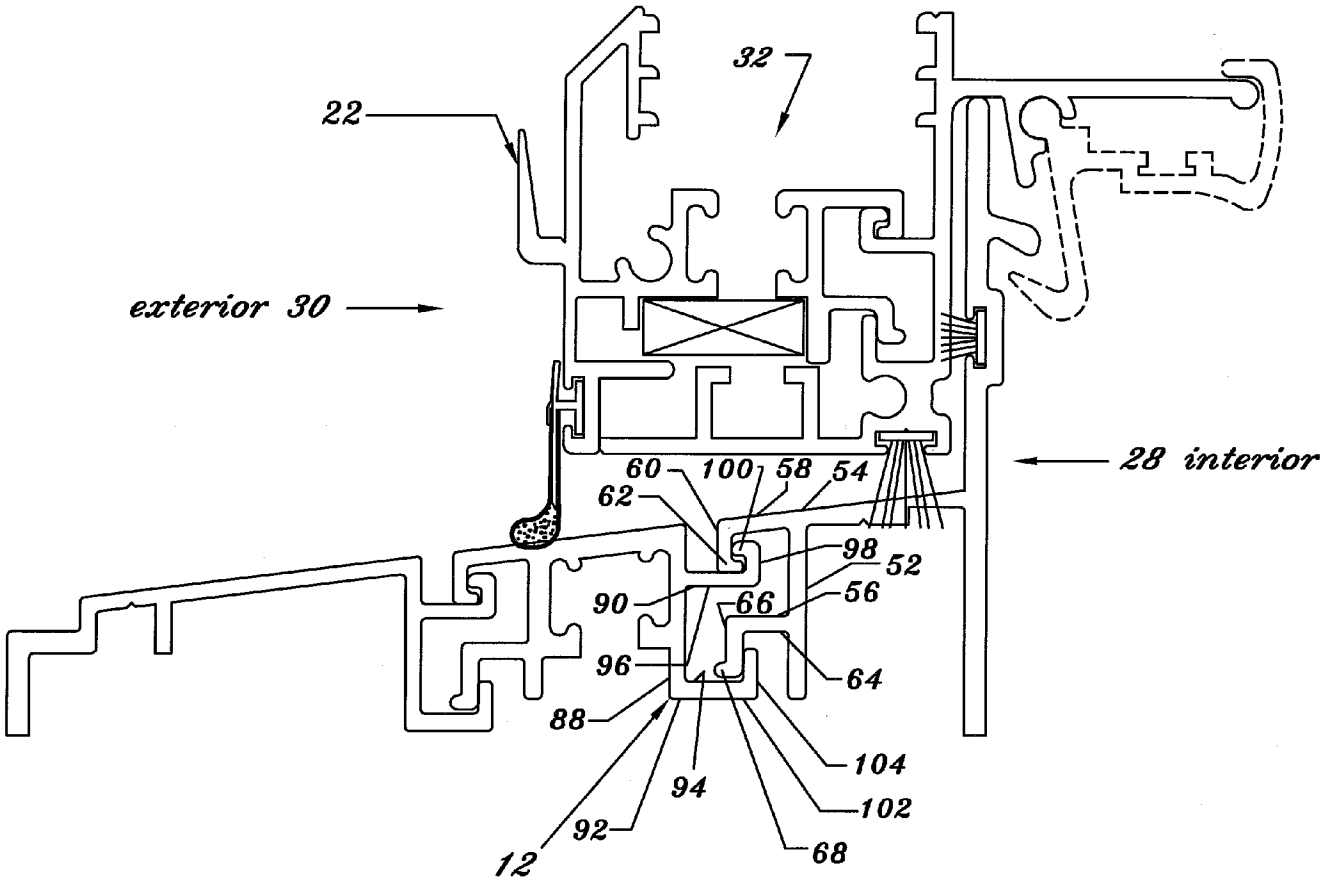
FIG. 6 (PRIOR ART)
FIG. 6 is an enlarged cross-sectional view of the sill of the conventional window shown in FIG. 4.

A double hung window 2 formed in accordance with the present invention is shown in FIG. 1 of the drawings. The double hung window 2 looks like a conventional window, but includes one or more intermediate, depth-extending pieces 4 between most, if not all, of the components of the interior section and the exterior section of the window. The window 2 includes a left jamb 6 (when viewing the interior side of the window), a right jamb 8 (when viewing the interior side of the window), a head 10 and an opposite sill 12 of the window frame 14. The window 2 also includes opposite left and right stiles 16, 18, a top rail 20, a bottom rail 22 and meeting rails 24, which are components of the window sashes 26 of the double hung window 2. Preferably, each of the aforementioned components is formed in two sections, an interior section 28 and an exterior section 30. Furthermore, preferably each of the interior section 28 and the exterior section 30 of each component can receive and couple to one or more intermediate, depth-extending pieces 4 interposed between the sections 28, 30. For more detail concerning the structure of a double hung window, both of a conventional, one-piece, extruded construction or constructed as a two-part window, reference should be had to the aforementioned Manzella, et al. U.S. Pat. No. 7,065,929, the disclosure of which is incorporated herein by reference.

FIGS. 2-6 show in longitudinal cross-section such a two-part, double-hung window 32 disclosed in the Manzella, et al. '929 patent. As can be seen from this cross-sectional view, the double hung window 32 includes a coupling to join the components of the sash 26 and frame 14 of the double hung window of the exterior section 30 to the corresponding components of the sash 26 and frame 14 of the interior section 28. More specifically, the head 10 of the window frame 14 of the interior section 28 includes an outrigger 34 and a hook 36, each of which extends from extruded walls forming portions of the head 10. Preferably, the head outrigger 34 includes a first segment 38 extending outwardly at preferably a 90° angle from a surface of a first extruded wall 40 of the head 10, a second segment 42 extending outwardly from the end of the first segment 38 at preferably a 90° thereto, and a third, free end segment 44 extending at preferably a 90° angle from the second segment 42 in a direction away from the first wall 40 of the head 10 and disposed in parallel with the first segment 38 of the head outrigger 34.

The hook 36 on the interior section 28 of the head 10 of the frame 14 of the window 32 extends outwardly from a surface of a second extruded wall 46 of the head, which second wall 46 is preferably situated perpendicularly to the first wall 40 of the head 10 from which the head outrigger 34 extends. The hook 36 includes a first segment 48 which extends outwardly at preferably a 90° angle from the surface of the second wall 46 of the head 10, and a second segment 50, having a free end, which extends preferably at a 90° angle from the end of the first segment 48 of the hook 36 towards the first wall 40 of the head 10 from which the head outrigger 34 extends. The head hook 36 and head outrigger 34 are spaced apart from each other a predetermined distance.

Similarly, the sill portion 12 of the interior section 28 of the frame 14 includes an extruded first wall 52 from which extends a hook 54 and another outrigger 56. The sill hook 54 of the interior section 28 includes a first segment 58 which extends outwardly from the first wall 52 of the sill 12, a second segment 60 which extends transversely from the first segment 58, and a third segment 62 having a free end which preferably extends perpendicularly from the end of the second segment 60 and in a direction towards the first wall 52 of the sill 12. The outrigger 56 of the interior section 28 of the sill 12 of the frame 14 has a first segment 64 which extends outwardly at preferably a 90° angle from a surface of the first wall 52 of the sill 12, a second segment 66 which extends at preferably a 90° angle from the first segment 64, and a third segment 68 defining a free end which extends outwardly at preferably a 90° angle from the end of the second segment 66 and away from the first wall 52 of the sill 12.

The left and right jambs 6, 8 of the frame 14, on the interior side 28 thereof, which are not shown in FIGS. 2-6, also include comparable structure to that described with respect to the sill 12 and head 10, including hooks and outriggers having similar structure such as described previously.

As can also be seen from FIGS. 2-6 of the drawings, the components of the exterior section 30 of the double hung window 32 also include structure which couples with the hooks and outriggers of the head 10 and sill 12, and left and right jambs 6, 8, of the interior section 28 of the frame 14. More specifically, the exterior section 30 of the head 10 of the frame 14 includes a third extruded wall 70 having a surface from which extend a hook 72 and a flange 74 which defines an outrigger receiving slot 76. Even more particularly, the hook 72 of the exterior section 30 of the head 10 of the window frame 14 has a first segment 78 which extends outwardly at preferably a 90° angle from a surface of the third wall 70 of the head 10, a second segment 80 which extends at preferably a 90° angle downwardly from the first segment 78, and a turned-in third segment 82, defining a free end, which extends at preferably a 90° angle from the second segment 80 toward the surface of the third wall 70 of the head 10 from which the first segment 78 of the hook 72 extends. Similarly, the flange 74, which defines an outrigger receiving slot 76, includes a first segment 84 which extends outwardly from the surface of the third wall 70 of the head 10 at preferably a 90° angle, and a second segment 86, defining a free end, extending downwardly at preferably a 90° angle from the first segment 84, which is spaced apart a predetermined distance from the surface of the third wall 70 of the head 10 from which the first segment 84 of the flange 74 extends so as to define a space between the surface of the third wall 70 of the head 10 and the second segment 86 of the flange 74 for receiving at least the third segment 44 of the outrigger 34 of the interior section 28 of the head 10.

As can be seen from FIGS. 2-6 of the drawings, the outrigger 34 of the head 10 of the frame 14 of the double hung window 32, formed on the interior section 28 of the window, is received by the outrigger receiving slot 76 defined by the flange 74 of the head 10 of the frame 14 on the exterior section 30 of the window 32, and the hook 36 on the head 10 of the frame 14 on the interior section 28 of the window 32 engages the hook 72 on the head 10 the exterior section 30 of the window 32 to join these two components of the head 10 together.

Similarly, and as can be seen from FIGS. 2-6 of the drawings, the sill 12 of the frame 14 on the exterior section 30 of the double hung window 32 includes a second extruded wall 88 from which extends a hook 90 and a flange 92 that defines an outrigger receiving slot 94. More specifically, the hook 90 of the sill 12 on the exterior section 30 of the window 32 includes a first segment 96 which extends outwardly at preferably a 90° angle from a surface of the second wall 88 of the sill 12, a second segment 98 which extends upwardly at preferably a 90° angle from the first segment 96, and a third segment 100, defining a free end, which extends from the second segment 98 at preferably a 90° angle inwardly toward the surface of the second wall 88 of the sill 12 from which the first segment 96 of the hook 90 extends. The flange 92 of the sill 12 on the exterior section 30 of the window 32 includes a first segment 102 which extends outwardly at preferably a 90° angle from a surface of the second wall 88 of the sill 12, and a second segment 104 defining a free end which extends upwardly at preferably a 90° angle from the first segment 102. Thus, the second segment 104 of the flange 92 is spaced apart from the surface of the second wall 88 of the sill 12 from which the first segment 102 of the flange 92 extends to define a space between the surface of the second wall 88 of the sill 12 and the second segment 104 of the flange 92 for receiving at least the third segment 68 of the outrigger 56 of the sill 12 formed on the interior section 28 of the window 32. This may be seen from FIGS. 2-4 and 6 of the drawings. FIGS. 2-4 and 6 also show how the hook 54 of the sill 12 on the interior section 28 of the window 32 engages the hook 90 of the sill 12 on the exterior section 30 of the window 32 so that the outrigger 56 and hook 54 of the interior section 28 respectively couple with the outrigger receiving slot 94 and hook 90 of the exterior section 30 of the sill 12 to join the sill components of the exterior and interior sections 30, 28 of the window 32 together.

Similar structure may be used to couple the stiles 16 and rails 20, 22, 24 of each sash 26 of the double hung window 32 together. This structure, that is, hooks, outriggers and outrigger receiving slots defined by flanges, is shown in FIGS. 2-6 of the drawings.

The left and right jambs 6, 8 of the frame 14, which are not shown in FIGS. 2-6 of the drawings, includes similar structure on their exterior and interior sections 30, 28, that is, hooks, outriggers and outrigger receiving slots defined by flanges, so that the interior section 28 of the left and right jambs 6, 8 may be coupled with the corresponding components of the left and right jambs 6, 8 on the exterior section 30 of the window 32. As mentioned previously, reference should be had to the Manzella, et al. U.S. Pat. No. 7,065,929, the disclosure of which is incorporated herein by reference, for a detailed description of such coupling structure forming a two-part window.

Figure 7:
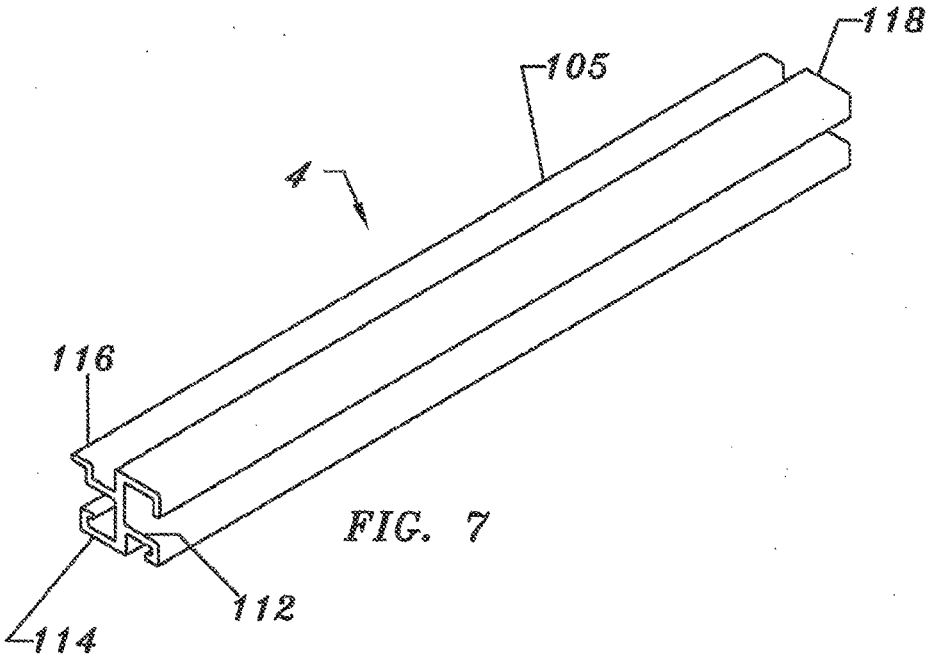
FIG. 7 is an isometric view of an intermediate, depth-extending piece for use with windows and doors to extend the depth thereof and formed in accordance with the present invention.
Figure 8:
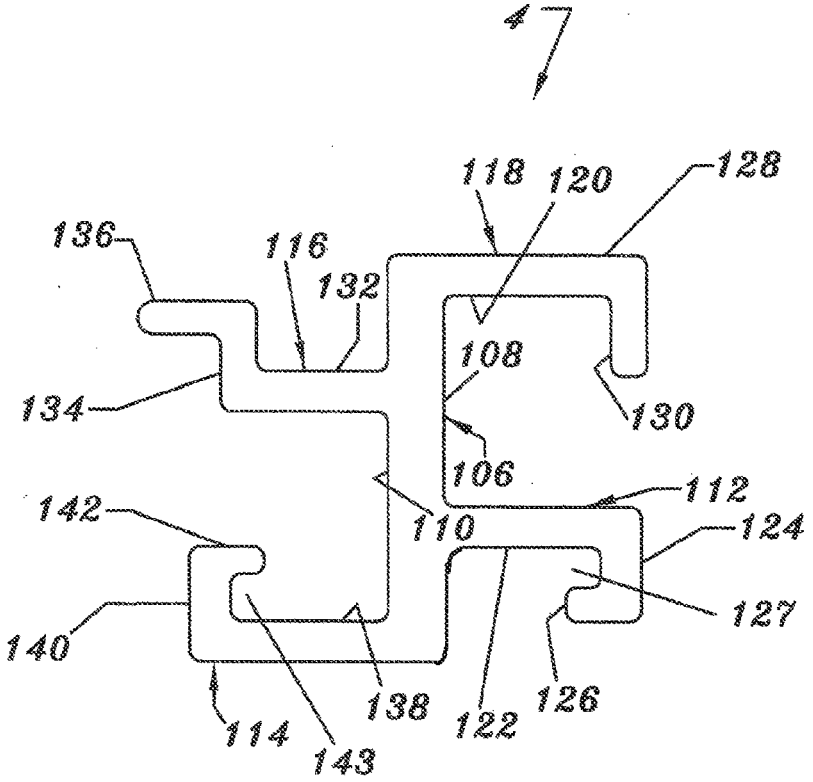
FIG. 8 is an end view of the intermediate, depth-extending piece of the present invention shown in FIG. 7.
Figure 9:
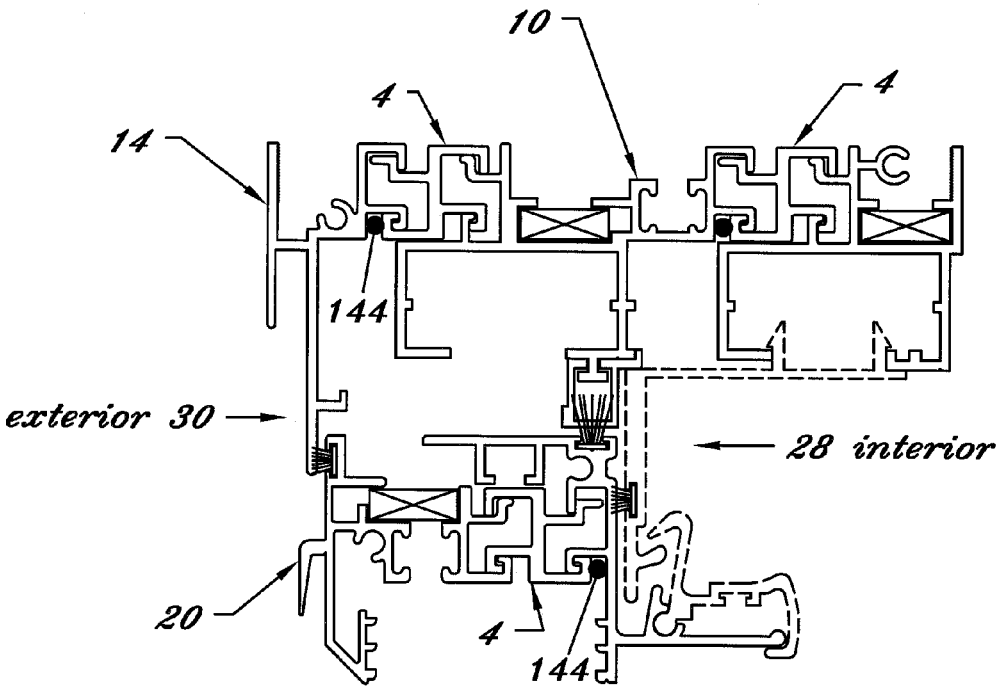
FIG. 9 is a longitudinal, cross-sectional view of a the head of the double hung window shown in FIG. 1, fitted with one or more intermediate, depth-extending pieces and formed in accordance with the present invention, taken along line 9-9 of FIG. 1.
Figure 10:
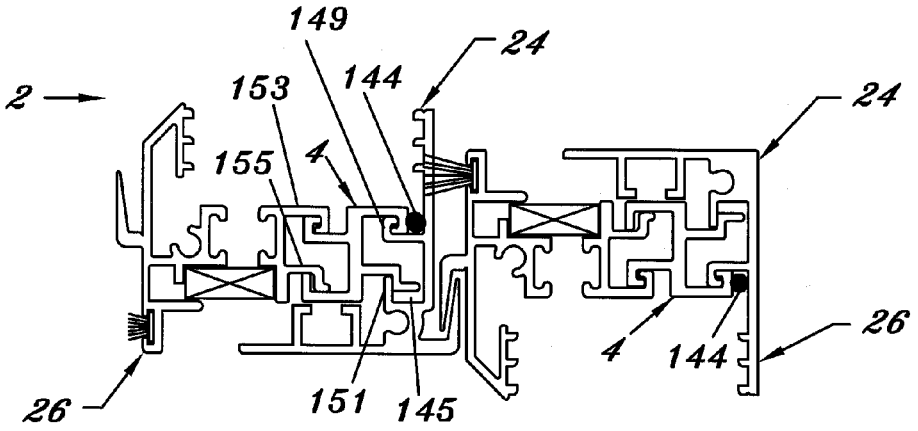
FIG. 10 is a longitudinal, cross-sectional view of the meeting rail section of the double hung window shown in FIG. 1, fitted with one or more intermediate, depth-extending pieces and formed in accordance with the present invention, taken along line 9-9 of FIG. 1.
Figure 11:
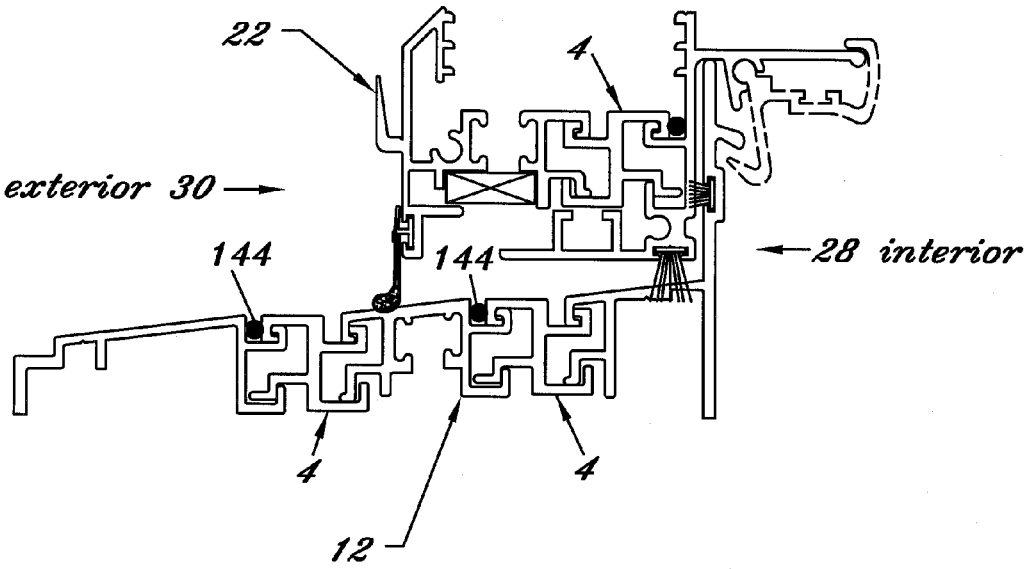
FIG. 11 is a longitudinal, cross-sectional view of the sill of the double hung window shown in FIG. 1, fitted with one or more intermediate, depth-extending pieces and formed in accordance with the present invention, taken along line 9-9 of FIG. 1.
Figure 12:
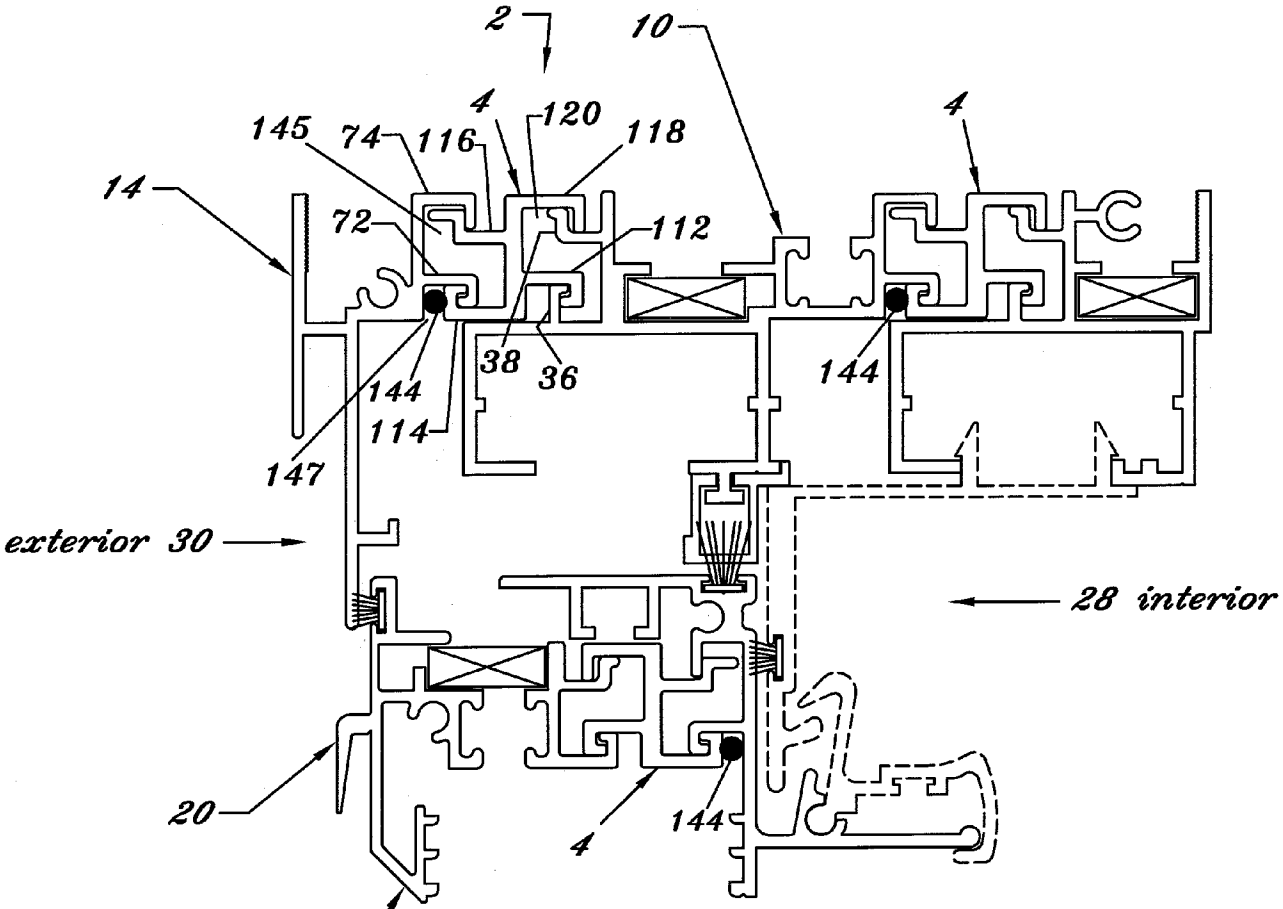
FIG. 12 is an enlarged cross-sectional view of the head of the window shown in FIG. 9, taken along line 9-9 of FIG. 1.
Figure 13:
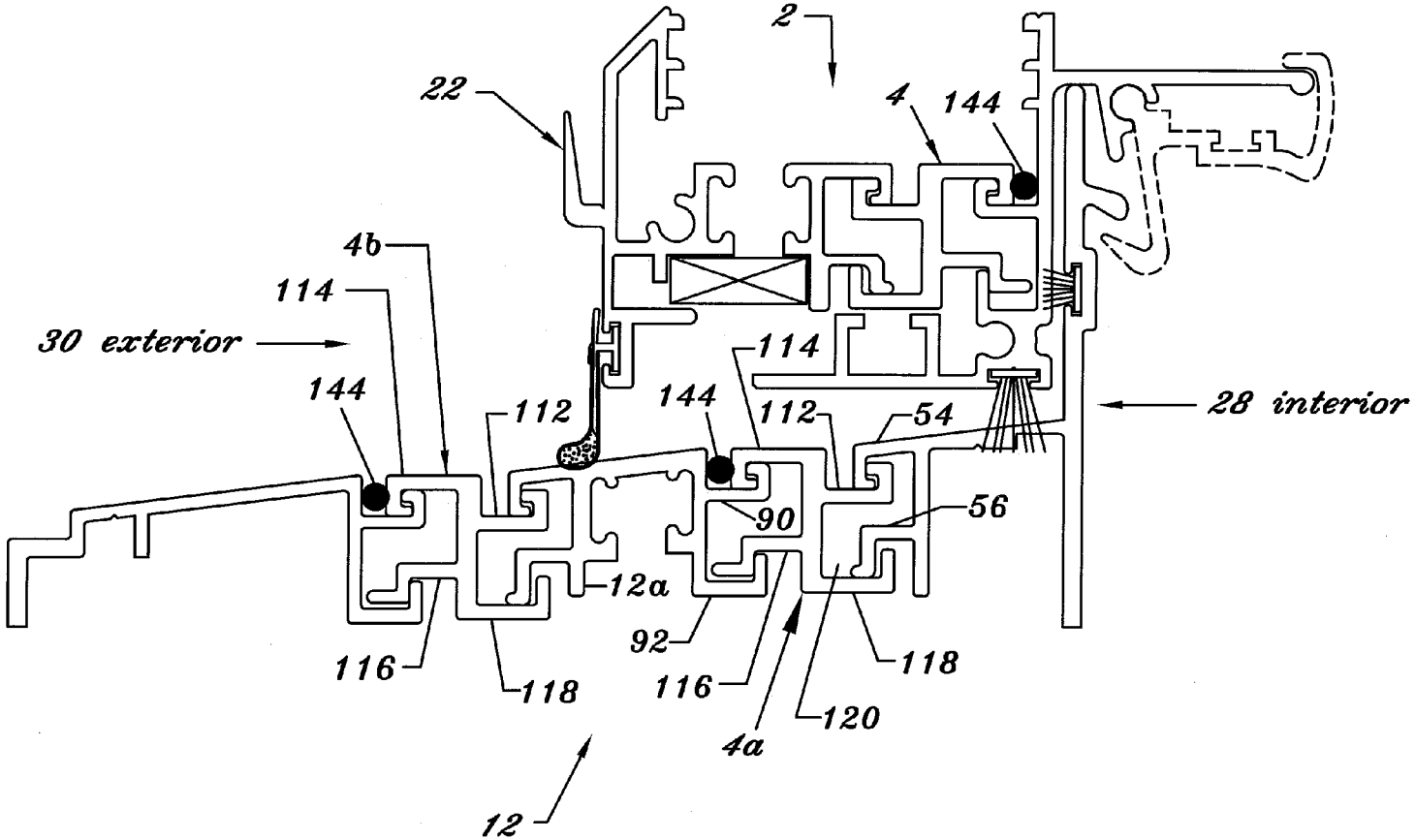
FIG. 13 is an enlarged cross-sectional view of the sill of the window shown in FIG. 10, taken along line 9-9 of FIG. 1.
Figure 14:
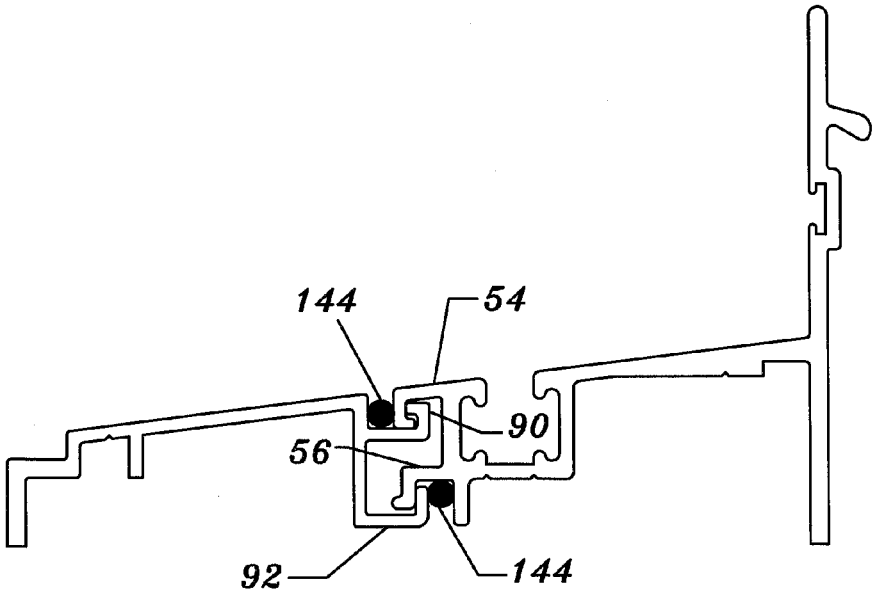
FIG. 14 (PRIOR ART)
FIG. 14 is a longitudinal, cross-sectional view of a conventional window sill of a double hung window prior to the sill being extended using the present invention.

In accordance with the present invention, the depth of the two-part window 32 may be selectively adjusted either in the manufacturing plant where the window is made or at the job site by including one or more intermediate pieces 4. Cross-sectional views of a double hung window 2, or portions thereof, having such intermediate, depth-extending pieces 4, are shown in FIGS. 9-13, 15 and 16 of the drawings, and views of the intermediate piece 4, formed in accordance with the present invention, are shown in FIGS. 7 and 8. An enlarged, cross-sectional view of a window sill 12, without the intermediate piece 4, is shown in FIG. 14 to further illustrate how the components of a window, or door, may be extended to various thicknesses.

With reference to FIGS. 7 and 8, it can be seen that each intermediate piece 4, which is preferably about one inch or less in thickness and height, and having a length which is chosen depending on the component (i.e., head 10, sill 12, stile 16, 18, rail 20-24, and jamb 6, 8) of the window 2 in which it is used, may be placed between and coupled to each component of the frame 14 and sash 26 of the exterior section 30 and interior section 28 of the window 2. Each intermediate, depth-extending piece 4 is an elongated, extruded component which includes a center support section 106 having opposite first and second side surfaces 108, 110, and hooks 112, 114, an outrigger 116 and a flange 118 defining an outrigger receiving slot 120 formed integrally with the center support section 106 and extending from the opposite first and second side surfaces 108, 110 thereof.

More specifically, the intermediate, depth-extending piece 4 includes a first hook 112 extending outwardly from a first side surface 108 of the center support section 106, a second hook 114 extending outwardly from the opposite second side surface 110 of the center support section 106, a flange 118 extending outwardly from the first surface 108 of the center support section 106, which defines an outrigger receiving slot 120, and an outrigger 116 extending outwardly from the second surface 110 of the center support section 106. The first hook 112 and the flange 118 are spaced apart from each other a predetermined distance from where they extend outwardly from the first surface 108 of the center support section 106. Similarly, the second hook 114 and the outrigger 116 are spaced apart from each other a predetermined distance from where they extend outwardly from the second surface 110 of the center support section 106.

Even more specifically, the first hook 112 of the intermediate, depth-extending piece 4 includes a first portion 122 which extends outwardly from the first surface 108 of the center support section 106 at preferably a 90° angle therefrom, a second portion 124 which extends downwardly from the first portion 122 at preferably a 90° angle therefrom, and a third portion 126 which defines a free end that extends at preferably a 90° angle from the second portion 124 toward the first surface 108 of the center support section 106 of the intermediate piece 4. This first hook 112 extending from the first surface 108 of the intermediate piece 4 couples with a hook formed on one of the components of either the frame 14 or sash 26 of the interior section 28 of the window 2, as shown in FIGS. 9-13, 15 and 16 of the drawings.

The flange 118 of the intermediate piece 4 includes a first portion 128 which extends outwardly from the first surface 108 of the center support section 106 of the intermediate piece 4 at preferably a 90° angle, and a second portion 130 defining a free end which extends downwardly at preferably a 90° angle from the first portion 128 such that the second portion 130 of the flange 118 is spaced apart from the first surface 108 of the center support section 106 of the intermediate piece 4 to define an outrigger receiving slot 120 therebetween. As can be seen from FIGS. 9-13, 15 and 16 of the drawings, the outrigger receiving slot 120 of the intermediate piece 4 receives an outrigger of one of the components of the frame 14 or sash 26 of the interior section 28 of the double hung window 2 to join the intermediate piece 4 to the interior section 28 of the window.

As mentioned previously, and as shown in FIGS. 7 and 8 of the drawings, the intermediate, depth-extending piece 4 further includes an outrigger 116 and a second hook 114 extending from the opposite second surface 110 of the center support section 106. More specifically, the outrigger 116 includes a first portion 132 which extends outwardly from the second surface 110 of the center support section 106 of the intermediate piece 4 at preferably a 90° angle thereto, a second portion 134 which extends upwardly from the first portion 132 at preferably a 90° angle therefrom, and a third portion 136, defining a free end, which extends outwardly from the second portion 134 at preferably a 90° angle therefrom and in a direction away from the second surface 110 of the center support section 106 of the intermediate piece 4. As can be seen from FIGS. 9-13, 15 and 16 of the drawings, at least the third portion 136, or free end, of the outrigger 116 of the intermediate piece 4 is received by a corresponding outrigger receiving slot defined by a flange formed on one of the components of the frame 14 or sash 26 of the exterior section 30 of the window 2 so as to couple the intermediate piece 4 with the corresponding component of the exterior section 30 of the window 2 and to join the exterior and interior window sections 30, 28 together.

The second hook 114 of the intermediate piece 4 includes a first portion 138 which extends outwardly from the second surface 110 of the center support section 106 of the intermediate piece 4 at preferably a 90° angle thereto, a second portion 140 which extends upwardly from the first portion 138 at preferably a 90° angle thereto, and a third portion 142, defining a free end, which extends inwardly towards the second surface 110 of the center support section 106 from the second portion 140 at preferably a 90° to the second portion 140. As can be seen from FIGS. 9-13, 15 and 16 of the drawings, this second hook 114 engages a hook formed on one of the components of the frame 14 or sash 22 of the exterior section 30 of the double hung window 2 to join the intermediate 4 piece to a respective component of the exterior section 30 of the window.

Such intermediate pieces 4 may be interposed between the components of the two-part window forming the left and right jambs 6, 8, the head 10 and sill 12 of the window 2 (or door frame), and the stiles 16, 18 and rails 20, 22, 24 foaming the window sashes 26, to join the components of the frame 14 and sash 26 of the exterior section 30 of the window 2 (or door) with the components of the interior section 28 of the window 2 (or door), to adjust the thickness of the window or door to a desired depth, as may be seen in FIGS. 9-13, 15 and 16 (FIG. 14 shows a window sill 12, without the intermediate piece 4).

A locking spline 144, which is preferably resilient, or another member, such as a wedge or the like, is press-fitted into the space between where one or both of the first and second hooks 112, 114 of the intermediate piece 4 engage the hooks of the components of the exterior section 30 and the interior section 28 of the window 2 between which the intermediate piece 4 is interposed. More specifically, and as can be seen from FIGS. 9-13, 15 and 16 of the drawings, when the intermediate piece 4 is placed between corresponding components of the exterior section 30 and the interior section 28 of the window 2, the first and second hooks 112, 114 of the intermediate piece 4 define spaces with the component walls from which the mating hooks extend. The locking spline 144, wedge or the like is press fitted into this space to selectively prevent disengagement of the hooks 112, 114 of the intermediate piece 4 and the hooks of the components of the exterior section 30 and interior section 28 of the window 2 so as to maintain the exterior section window components and the corresponding interior section window components as an assembled structure, with the intermediate piece 4 situated between the corresponding components.

It should be realized that the placement of the first and second hooks 112, 114, the flange 118 defining an outrigger receiving slot 120, and the outrigger 116, extending from the opposite first and second surfaces 108, 110 of the center support section 106 of the intermediate piece 4, may be reversed, such that the outrigger 116 and second hook 114 extend outwardly from the first surface 108 of the center support section 106 to mate with complementary structure on components of the interior section 28 of the window 2 or door, and the flange 118 defining an outrigger receiving slot 120, and the first hook 112, being instead situated to extend from the second surface 110 of the center support section 106 so as to couple with complementary structure formed on the components of the exterior section 30 of the window 2 or door.

Figure 15:
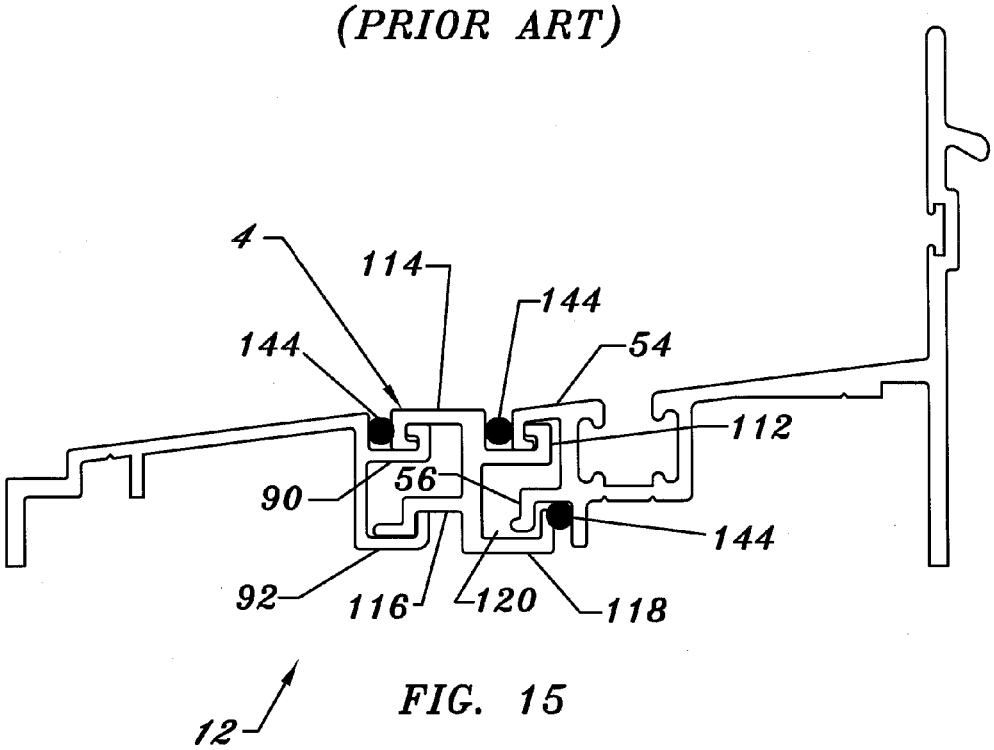
FIG. 15 is a longitudinal, cross-sectional view of the window sill shown in FIG. 14, now extended using one intermediate, depth-extending piece of the present invention.
Figure 16:
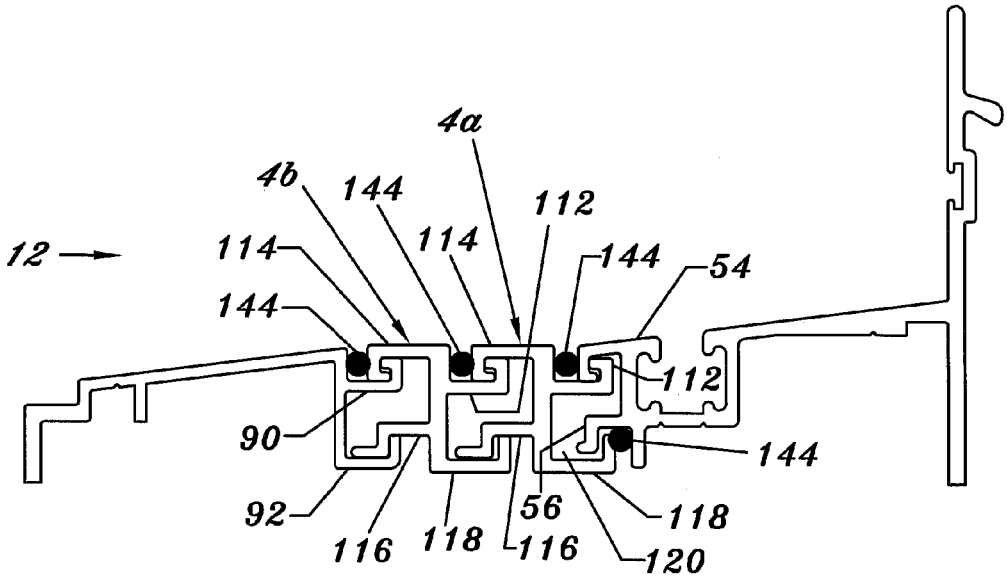
FIG. 16 is a longitudinal, cross-sectional view of the window sill shown in FIG. 14, now extended using two intermediate, depth-extending pieces of the present invention.

Furthermore, it should be realized that multiple intermediate pieces 4 may be interposed between the components of the exterior section 30 and the components of the interior section 28 of the window 2 or door to adjust the thickness of the window or door to an even greater depth. As shown in FIGS. 9-11 and 13 of the drawings, it can be seen that the sill 12 includes two intermediate pieces 4, that is, a first intermediate piece 4*a* joined to the sill portion 12 of the interior section 28 of the window 2, and a second intermediate piece 4*b* joined to an outer sill portion of the exterior section 30 of the window 2, and the two intermediate pieces are joined to a middle section 12*a* of the sill 12. Alternatively, and as can be seen from the structure of the intermediate piece 4 described above and shown in FIGS. 7 and 8 of the drawings, and as illustrated by FIGS. 15 and 16, two or more intermediate pieces 4 may be joined together and situated between the components of the exterior section 30 and interior section 28 of the window 2 or door. For example, the outrigger 116 of a first intermediate piece 4*a* may be received by the outrigger receiving slot 120 defined by a flange 118 of a second intermediate piece 4*b*, and the second hook 114 of a first intermediate piece 4*a* may be engagable with the first hook 112 of a second intermediate piece 4*b*. Similarly, the first hook 112 of the first intermediate piece 4*a* may be engagable with a second hook 114 of a third intermediate piece (not shown), and the outrigger receiving slot 120 of the first intermediate piece 4*a* may receive an outrigger 116 of a third intermediate piece (not shown) such that a first intermediate piece 4*a* may be sandwiched between and coupled to a second intermediate piece 4*b* and a third intermediate piece (not shown), with the second intermediate piece 4*b* and third intermediate piece (not shown) being joined to corresponding components of the exterior section 30 and interior section 28 of the window 2 or door. Again, locking splines 144, wedges or the like are used between engaging hooks 112, 114 of the intermediate pieces 4*a*, 4*b* and the components of the exterior and interior sections 30, 28 of the window 2 or door to join the window or door components together, with the intermediate pieces 4*a*, 4*b* situated therebetween, as shown in FIGS. 15 and 16.

Accordingly, as described previously and shown in the drawings, an intermediate member 4 for extending the depth of a window or door includes an elongated body 105. The elongated body 105 has a central support section 106. The central support section 106 includes a first side 108 and a second side 110 situated opposite the first side 108. Each of the first side 108 and the second side 110 has a surface.

The intermediate member 4 further includes a first hook 112 extending outwardly from the surface of the first side 108 of the central support section 106, and a flange 118 extending outwardly from the surface of the first side 108 of the central support section 106 and spaced from the first hook 112. The flange 118 defines an outrigger receiving slot 120 for receiving an elongated member of one of the window, the door and another intermediate member 4.

The intermediate member 4 also includes a second hook 114 extending outwardly from the surface of the second side 110 of the central support section 106, and an outrigger 116 formed as an elongated member and extending outwardly from the surface of the second side 110 of the central support section 106 and spaced from the second hook 114.

Preferably, the outrigger 116 of the intermediate member 4 includes at least a first portion 132 and a second portion 134. The first portion 132 is joined to and extends outwardly from the surface of the second side 110 of the central support section 106. The first portion 132 has an end, and the second portion 134 is joined to the end of the first portion 132 and extends therefrom at an angle thereto. Preferably, the second portion 134 of the outrigger 116 extends from the first portion 132 of the outrigger at an angle of about 90 degrees.

In another preferred form of the intermediate member 4, the second portion 134 of the outrigger 116 includes an end, and the outrigger 116 includes a third portion 136. The third portion 136 extends from the end of the second portion 134 of the outrigger 116 at an angle thereto, such as about 90 degrees.

Even more preferably, each of the first hook 112 and the second hook 114 of the intermediate member 4 includes a first portion 122, 138, a second portion 124, 140 and a third portion 126, 142. The first portion 122 of the first hook 112 extends outwardly from the surface of the first side 108 of the central support section 106. The first portion 138 of the second hook 114 extends outwardly from the surface of the second side 110 of the central support section 106. Each of the first portions 122, 138 of the first hook 112 and the second hook 114 has an end, and each of the second portions 124, 140 of the first hook 112 and the second hook 114 extends from the end of the respective first portion 122, 138 of the first hook 112 and the second hook 114 and transversely thereto. Each of the second portions 124, 140 of the first hook 112 and the second hook 114 also have an end, and each of the third portions 126, 142 of the first hook 112 and the second hook 114 extends from the end of the respective second portion 124, 140 of the first hook 112 and the second hook 114 and transversely thereto. The third portion 126 of the first hook 112 is spaced from the first portion 122 of the first hook 112 to define with the first portion 122 of the first hook 112 a first cooperating hook receiving slot 127. Similarly, the third portion 142 of the second hook 114 is spaced from the first portion 138 of the second hook 114 to define with the first portion 138 of the second hook 114 a second cooperating hook receiving slot 143.

In yet another preferred form, the present invention is directed to the combination of the intermediate member 4 having the structure described above, and a locking component 144. The locking component 144 is situated adjacent to at least one of the first hook 112 and the second hook 114. Preferably, the locking component 144 is selectively removable from in proximity to the at least one of the first hook 112 and the second hook 114 of the intermediate member 4, and may be in the form of one of a spline and a wedge.

In a further preferred form, the present invention is directed to an assembly of one of a window and a door, which includes an exterior side component 30, an interior side component 28 and an intermediate member 4 having the structure described previously and which is situated between the exterior side component 30 and the interior side component 28.

The exterior side component 30 has a surface, an exterior side component hook 72 extending outwardly from the surface of the exterior side component 30 and a flange 74 extending outwardly from the surface of the exterior side component 30 and spaced from the exterior side component hook 72. The flange 74 of the exterior side component 30 defines an outrigger receiving slot 145 on the exterior side component 30.

The interior side component 28 is situated opposite the exterior side component 30, and includes a surface, an interior side component hook 36 extending outwardly from the surface of the interior side component 28 and an outrigger 38 in the form of an elongated member extending outwardly from the surface of the interior side component 28 and spaced from the interior side component hook 36.

As stated previously, the intermediate member 4 is situated between the exterior side component 30 and the interior side component 28 of the window or door assembly and extends the depth of the assembly. The intermediate member 4 includes an elongated body 105. The elongated body 105 has a central support section 106. The central support section 106 has a first side 108 and a second side 110 situated opposite the first side 108. Each of the first side 108 and the second side 110 has a surface. The surface of the first side 108 of the central support section 106 of the intermediate member 4 faces the surface of the interior side component 28, and the surface of the second side 110 of the central support section 106 of the intermediate member 4 faces the surface of the exterior side component 30.

The intermediate member 4 further includes a first hook 112 extending outwardly from the surface of the first side 108 of the central support section 106, the first hook 112 engaging the interior side component hook 36. There is also a flange 118 that extends outwardly from the surface of the first side 108 of the central support section 106 and is spaced from the first hook 112. The flange 118 defines an outrigger receiving slot 120. The outrigger 38 of the interior side component 28 is at least partially received by the outrigger receiving slot 120 of the flange 118 of the intermediate member 4.

The intermediate member 4 also includes a second hook 114 that extends outwardly from the surface of the second side 110 of the central support section 106, the second hook 114 engaging the exterior component side hook 72. Additionally, the intermediate member 4 has an outrigger 116 formed as an elongated member which extends outwardly from the surface of the second side 110 of the central support section 106 and is spaced from the second hook 114. The outrigger 116 of the intermediate member 4 is at least partially received by the outrigger receiving slot 145 of the flange 74 of the exterior side component 30. At least one of the first hook 112 and the second hook 114 of the intermediate member 4 respectively defines with at least one of the surface of the interior side component 28 and the surface of the exterior side component 30 a space 147 therebetween.

The preferred assembly of the present invention further includes a locking component 144. The locking component 144 is received in the space 147 to prevent the disengagement of at least one of the first hook 112 of the intermediate member 4 and the interior side component hook 36 and the second hook 114 of the intermediate member 4 and the exterior side component hook 72.

In a more preferred form, the locking component 144 is selectively removable from the space 147 to allow the disjoining of at least one of the exterior side component 30 and the intermediate member 4 and the interior side component 28 and the intermediate member 4.

In another form of the window or door assembly described above, the outrigger 116 of the intermediate member 4 includes at least a first portion 132 and a second portion 134. The first portion 132 is joined to and extends outwardly from the surface of the second side 110 of the central support section 106 of the intermediate member 4. The first portion 132 has an end, and the second portion 134 is joined to the end of the first portion 132 and extends therefrom at an angle thereto, which is preferably about 90 degrees.

Even more preferably, the second portion 134 of the outrigger 116 of the intermediate member 4 includes an end, and the outrigger 116 of the intermediate member 4 includes a third portion 136. The third portion 136 extends from the end of the second portion 134 of the outrigger 116 at an angle thereto, which again is preferably about 90 degrees.

In still another preferred form of the window or door assembly of the present invention, each of the first hook 112 and the second hook 114 of the intermediate member 4 includes a first portion 122, 138, a second portion 124, 140 and a third portion 126, 142. The first portion 122 of the first hook 112 extends outwardly from the surface of the first side 108 of the central support section 106 of the intermediate member 4. The first portion 138 of the second hook 114 extends outwardly from the surface of the second side 110 of the central support section 106. Each of the first portions 122, 138 of the first hook 112 and the second hook 114 has an end, and each of the second portions 124, 140 of the first hook 112 and the second hook 114 extends from the end of the respective first portion 122, 138 of the first hook 112 and the second hook 114 and transversely thereto. Similarly, each of the second portions 124, 140 of the first hook 112 and the second hook 114 has an end, and each of the third portions 126, 142 of the first hook 112 and the second hook 114 extends from the end of the respective second portion 124, 140 of the first hook 112 and the second hook 114 and transversely thereto. The third portion 126 of the first hook 112 is spaced from the first portion 122 of the first hook 112 to define with the first portion 122 of the first hook 112 a first cooperating hook receiving slot 127. The third portion 142 of the second hook 114 is spaced from the first portion 138 of the second hook 114 to define with the first portion 138 of the second hook 114 a second cooperating hook receiving slot 143. The first cooperating hook receiving slot 127 receives at least a portion of the interior side component hook 36 of the interior side component 28, and the second cooperating hook receiving slot 143 receives at least a portion of the exterior side component hook 72 of the exterior side component 30.

Preferably, the intermediate member 4 may be turned around in the window or door assembly such that the surface of the first side 108 of the central support section 106 faces the surface of the exterior side component 30, and the surface of the second side 110 of the central support section 106 faces the surface of the interior side component 28. Such an arrangement is described in detail below, and is shown by way of example in FIG. 10 with respect to the meeting rails 24 of the sash 26 of a double hung window 2.

More specifically, an assembly of one of a window and a door includes an interior side component 28, an exterior side component 30 and an intermediate member 4 having the structure described previously and which is situated between the interior side component 28 and the exterior side component 30.

The interior side component 28 has a surface, an interior side component hook 149 extending outwardly from the surface of the interior side component 28 and a flange 151 extending outwardly from the surface of the interior side component 28 and spaced from the interior side component hook 149. The flange 151 of the interior side component 28 defines an outrigger receiving slot 145 on the interior side component 28.

The exterior side component 30 is situated opposite the interior side component 28, and includes a surface, an exterior side component hook 153 extending outwardly from the surface of the exterior side component 30 and an outrigger 155 in the form of an elongated member extending outwardly from the surface of the exterior side component 30 and spaced from the exterior side component hook 153.

As stated previously, the intermediate member 4 is situated between the interior side component 28 and the exterior side component 30 of the window or door assembly and extends the depth of the assembly. The intermediate member 4 includes an elongated body 105. The elongated body 105 has a central support section 106. The central support section 106 has a first side 108 and a second side 110 situated opposite the first side 108. Each of the first side 108 and the second side 110 has a surface. The surface of the first side 108 of the central support section 106 of the intermediate member 4 faces the surface of the exterior side component 30, and the surface of the second side 110 of the central support section 106 of the intermediate member 4 faces the surface of the interior side component 28.

The intermediate member 4 further includes a first hook 112 extending outwardly from the surface of the first side 108 of the central support section 106, the first hook 112 engaging the exterior side component hook 153. There is also a flange 118 that extends outwardly from the surface of the first side 108 of the central support section 106 and is spaced from the first hook 112. The flange 118 defines an outrigger receiving slot 120. The outrigger 155 of the exterior side component 30 is at least partially received by the outrigger receiving slot 120 of the flange 118 of the intermediate member 4.

The intermediate member 4 also includes a second hook 114 that extends outwardly from the surface of the second side 110 of the central support section 106, the second hook 114 engaging the interior component side hook 149. Additionally, the intermediate member 4 has an outrigger 116 formed as an elongated member which extends outwardly from the surface of the second side 110 of the central support section 106 and is spaced from the second hook 114. The outrigger 116 of the intermediate member 4 is at least partially received by the outrigger receiving slot 145 of the flange 151 of the interior side component 28. At least one of the first hook 112 and the second hook 114 of the intermediate member 4 respectively defines with at least one of the surface of the exterior side component 30 and the surface of the interior side component 28 a space 147 therebetween.

The preferred assembly of the present invention further includes a locking component 144. The locking component 144 is received in the space 147 to prevent the disengagement of at least one of the first hook 112 of the intermediate member 4 and the exterior side component hook 153 and the second hook 114 of the intermediate member 4 and the interior side component hook 149.

In a more preferred form, the locking component 144 is selectively removable from the space 147 to allow the disjoining of at least one of the interior side component 28 and the intermediate member 4 and the exterior side component 30 and the intermediate member 4.

In another form of the window or door assembly described above, the outrigger 116 of the intermediate member 4 includes at least a first portion 132 and a second portion 134. The first portion 132 is joined to and extends outwardly from the surface of the second side 110 of the central support section 106 of the intermediate member 4. The first portion 132 has an end, and the second portion 134 is joined to the end of the first portion 132 and extends therefrom at an angle thereto, which is preferably about 90 degrees.

Even more preferably, the second portion 134 of the outrigger 116 of the intermediate member 4 includes an end, and the outrigger 116 of the intermediate member 4 includes a third portion 136. The third portion 136 extends from the end of the second portion 134 of the outrigger 116 at an angle thereto, which again is preferably about 90 degrees.

In still another preferred form of the window or door assembly of the present invention, each of the first hook 112 and the second hook 114 of the intermediate member 4 includes a first portion 122, 138, a second portion 124, 140 and a third portion 126, 142. The first portion 122 of the first hook 112 extends outwardly from the surface of the first side 108 of the central support section 106 of the intermediate member 4. The first portion 138 of the second hook 114 extends outwardly from the surface of the second side 110 of the central support section 106. Each of the first portions 122, 138 of the first hook 112 and the second hook 114 has an end, and each of the second portions 124, 140 of the first hook 112 and the second hook 114 extends from the end of the respective first portion 122, 138 of the first hook 112 and the second hook 114 and transversely thereto. Similarly, each of the second portions 124, 140 of the first hook 112 and the second hook 114 has an end, and each of the third portions 126, 142 of the first hook 112 and the second hook 114 extends from the end of the respective second portion 124, 140 of the first hook 112 and the second hook 114 and transversely thereto. The third portion 126 of the first hook 112 is spaced from the first portion 122 of the first hook 112 to define with the first portion 122 of the first hook 112 a first cooperating hook receiving slot 127. The third portion 142 of the second hook 114 is spaced from the first portion 138 of the second hook 114 to define with the first portion 138 of the second hook 114 a second cooperating hook receiving slot 143. The first cooperating hook receiving slot 127 receives at least a portion of the exterior side component hook 153 of the exterior side component 30, and the second cooperating hook receiving slot 143 receives at least a portion of the interior side component hook 149 of the interior side component 28.

As stated previously, the window or door assembly may have two or more intermediate members 4 to extend the depth of the window or door assembly. The intermediate members 4 may be separated from one another and interposed between components 28, 30 of the window or door assembly, or may be situated adjacent to and lockingly engaging one another. Accordingly, the present invention encompasses the combination of a first intermediate member **4*a* and at least a second intermediate member 4*b* which engages the first intermediate member 4*a*, the first and second intermediate members 4*a*, 4*b*, and any additional intermediate members 4**, being used to extend the depth of the window or door.

More specifically, the first intermediate member **4*a* includes an elongated body 105, the elongated body 105 having a central support section 106, the central support section 106 having a first side 108 and a second side 110 situated opposite the first side 108. Each of the first side 108 and the second side 110 has a surface. The first intermediate member 4*a* further includes a first hook 112 extending outwardly from the surface of the first side 108 of the central support section 106, and a flange 118 extending outwardly from the surface of the first side 108 of the central support section 106 and spaced from the first hook 112, the flange 118 defining an outrigger receiving slot 120**.

The first intermediate member **4*a* further includes a second hook 114 extending outwardly from the surface of the second side 110 of the central support section 106, and an outrigger 116 formed as an elongated member and extending outwardly from the surface of the second side 110 of the central support section 106 and spaced from the second hook 114**.

Similarly, the at least second intermediate member **4*b* includes an elongated body 105, the elongated body 105 having a central support section 106, the central support section 106 having a first side 108 and a second side 110 situated opposite the first side 108, each of the first side 108 and the second side 110 having a surface, the surface of the second side 110 of the central support section 106 of the at least second intermediate member 4*b* facing the surface of the first side 108 of the central support section 106 of the first intermediate member 4*a*. The second intermediate member 4*b* also includes a first hook 112 extending outwardly from the surface of the first side 108 of the central support section 106**.

Furthermore, the at least second intermediate member **4*b* has a flange 118 extending outwardly from the surface of the first side 108 of the central support section 106 and spaced from the first hook 112, the flange 118 defining an outrigger receiving slot 120 for receiving an elongated member of one of the window, the door and another intermediate member 4 other than the first intermediate member 4*a* and the second intermediate member 4*b*. Also, the at least second intermediate member 4*b* includes a second hook 114 extending outwardly from the surface of the second side 110 of the central support section 106. The second hook 114 of the at least second intermediate member 4*b* engages the first hook 112 of the first intermediate member 4*a*. The at least second intermediate member 4*b* also includes an outrigger 116 formed as an elongated member and extending outwardly from the surface of the second side 110 of the central support section 106 and spaced from the second hook 114. The outrigger 116 of the at least second intermediate member 4*b* is at least partially received by the outrigger receiving slot 120 of the flange 118 of the first intermediate member 4*a***.

In a preferred form of the combination described above, at least one of the first hook 112 of the first intermediate member **4*a* and the second hook 114 of the at least second intermediate member 4*b* respectively defines with at least one of the surface of the second side 110 of the central support section 106 of the at least second intermediate member 4*b* and the surface of the first side 108 of the central support section 106 of the first intermediate member 4*a* a space 147 therebetween. Furthermore, the combination may include a locking component 144. The locking component 144 is received in the space 147 to prevent the disengagement of the first hook 112 of the first intermediate member 4*a* and the second hook 114 of the at least second intermediate member 4*b***.

Although illustrative embodiments of the present invention have been described herein with reference to the accompanying drawings, it is to be understood that the invention is not limited to those precise embodiments and that various other changes and modifications may be effected herein by one skilled in the art without departing from the scope or spirit of the invention.

What is claimed is:

1. An intermediate member for extending a depth of a window or door, which comprises:

an elongated body, the elongated body having a central support section comprising a single vertical wall, the single vertical wall single vertical wall of the central support section having a first side and a second side situated opposite the first side, each of the first side and the second side having a surface;

a first hook extending outwardly directly from and being attached directly to the surface of the first side of the single vertical wall of the central support section;

a flange extending outwardly directly from and being attached directly to the surface of the first side of the single vertical wall of the central support section and spaced from the first hook, the flange defining an outrigger receiving slot for receiving an elongated member of the window, the door or another intermediate member;

a second hook extending outwardly directly from and being attached directly to the surface of the second side of the single vertical wall of the central support section; and an outrigger formed as an elongated member and extending outwardly directly from and being attached directly to the surface of the second side of the single vertical wall of the central support section and spaced from the second hook.

2. The intermediate member as defined by claim 1, wherein the outrigger includes at least a first portion and a second portion, the first portion being joined directly to and extending outwardly directly from the surface of the second side of the single vertical wall of the central support section, the first portion having an end, the second portion being joined to the end of the first portion and extending therefrom at an angle thereto.

3. The intermediate member as defined by claim 2, wherein the second portion of the outrigger extends from the first portion of the outrigger at an angle of about 90 degrees.

4. The intermediate member as defined by claim 2, wherein the second portion of the outrigger includes an end; and wherein the outrigger includes a third portion, the third portion extending from the end of the second portion of the outrigger at an angle thereto.

5. The intermediate member as defined by claim 4, wherein the third portion of the outrigger extends from the second portion of the outrigger at an angle of about 90 degrees.

6. The intermediate member as defined by claim 1, wherein each of the first hook and the second hook includes a first portion, a second portion and a third portion, the first portion of the first hook extending outwardly directly from and being joined directly to the surface of the first side of the single vertical wall of the central support section, the first portion of the second hook extending outwardly directly from and being joined directly to the surface of the second side of the single vertical wall of the central support section, each of the first portions of the first hook and the second hook having an end, each of the second portions of the first hook and the second hook extending from the end of the respective first portion of the first hook and the second hook and transversely thereto, each of the second portions of the first hook and the second hook having an end, each of the third portions of the first hook and the second hook extending from the end of the respective second portion of the first hook and the second hook and transversely thereto, the third portion of the first hook being spaced from the first portion of the first hook to define with the first portion of the first hook a first cooperating hook receiving slot, the third portion of the second hook being spaced from the first portion of the second hook to define with the first portion of the second hook a second cooperating hook receiving slot.

7. In combination:

an intermediate member for extending a depth of a window or door, which includes:

an elongated body, the elongated body having a central support section comprising a single vertical wall, the single vertical wall of the central support section having a first side and a second side situated opposite the first side, each of the first side and the second side having a surface;

a first hook extending outwardly directly from and being attached directly to the surface of the first side of the single vertical wall of the central support section;

a flange extending outwardly directly from and being attached directly to the surface of the first side of the single vertical wall of the central support section and spaced from the first hook, the flange defining an outrigger receiving slot for receiving an elongated member of the window, the door or another intermediate member;

a second hook extending outwardly directly from and being attached directly to the surface of the second side of the single vertical wall of the central support section; and an outrigger formed as an elongated member and extending outwardly directly from and being attached directly to the surface of the second side of the single vertical wall of the central support section and spaced from the second hook; and a locking component, the locking component being situated adjacent to the first hook or the second hook.

8. The combination as defined by claim 7, wherein the locking component is removable from a position adjacent to the first hook or the second hook.

9. The combination as defined by claim 7, wherein the locking component is in the form of a spline or a wedge.

10. An assembly of a window or a door, which comprises:

an exterior side component, the exterior side component having a surface, an exterior side component hook extending outwardly from the surface of the exterior side component and a flange extending outwardly from the surface of the exterior side component and spaced from the exterior side component hook, the flange of the exterior side component defining an outrigger receiving slot on the exterior side component;

an interior side component situated opposite the exterior side component, the interior side component having a surface, an interior side component hook extending outwardly from the surface of the interior side component and an outrigger in the form of an elongated member extending outwardly from the surface of the interior side component and spaced from the interior side component hook;

an intermediate member situated between the exterior side component and the interior side component and extending a depth of the assembly of the window or the door, the intermediate member including:

an elongated body, the elongated body having a central support section comprising an single vertical wall, the single vertical wall of the central support section having a first side and a second side situated opposite the first side, each of the first side and the second side having a surface, the surface of the first side of the single vertical wall of the central support section of the intermediate member facing the surface of the interior side component, the surface of the second side of the single vertical wall of the central support section of the intermediate member facing the surface of the exterior side component;

a first hook extending outwardly directly from and being attached directly to the surface of the first side of the single vertical wall of the central support, the first hook engaging the interior side component hook;

a flange extending outwardly directly from and being attached directly to the surface of the first side of the single vertical wall of the central support section and spaced from the first hook, the flange defining an outrigger receiving slot, the outrigger of the interior side component being at least partially received by the outrigger receiving slot of the flange of the intermediate member;

a second hook extending outwardly directly from and being attached directly to the surface of the second side of the single vertical wall of the central support section, the second hook engaging the exterior component side hook; and an outrigger formed as an elongated member and extending outwardly directly from and being attached directly to the surface of the second side of the single vertical wall of the central support section and spaced from the second hook, the outrigger of the intermediate member being at least partially received by the outrigger receiving slot of the flange of the exterior side component, wherein at least one of the first hook and the second hook of the intermediate member respectively defines with at least one of the surface of the interior side component and the surface of the exterior side component a space therebetween; and a locking component, the locking component being received in the space to prevent the disengagement of the first hook of the intermediate member and the interior side component hook or the second hook of the intermediate member and the exterior side component hook.

11. The assembly of a window or a door as defined by claim 10, wherein the locking component is removable from the space to allow disjoining of the exterior side component and the intermediate member or the interior side component and the intermediate member.

12. The assembly of a window or a door as defined by claim 10, wherein the outrigger of the intermediate member includes at least a first portion and a second portion, the first portion being joined directly to and extending outwardly directly from the surface of the second side of the single vertical wall of the central support section of the intermediate member, the first portion having an end, the second portion being joined to the end of the first portion and extending therefrom at an angle thereto.

13. The assembly of a window or a door as defined by claim 12, wherein the second portion of the outrigger of the intermediate member includes an end; and wherein the outrigger of the intermediate member includes a third portion, the third portion extending from the end of the second portion of the outrigger at an angle thereto.

14. The assembly of a window or a door as defined by claim 10, wherein each of the first hook and the second hook of the intermediate member includes a first portion, a second portion and a third portion, the first portion of the first hook extending outwardly directly from and being joined directly to the surface of the first side of the single vertical wall of the central support section of the intermediate member, the first portion of the second hook extending outwardly directly from and being joined directly to the surface of the second side of the single vertical wall of the central support section, each of the first portions of the first hook and the second hook having an end, each of the second portions of the first hook and the second hook extending from the end of the respective first portion of the first hook and the second hook and transversely thereto, each of the second portions of the first hook and the second hook having an end, each of the third portions of the first hook and the second hook extending from the end of the respective second portion of the first hook and the second hook and transversely thereto, the third portion of the first hook being spaced from the first portion of the first hook to define with the first portion of the first hook a first cooperating hook receiving slot, the third portion of the second hook being spaced from the first portion of the second hook to define with the first portion of the second hook a second cooperating hook receiving slot, the first cooperating hook receiving slot receiving at least a portion of the interior side component hook of the interior side component, the second cooperating hook receiving slot receiving at least a portion of the exterior side component hook of the exterior side component.

15. An assembly of a window or a door, which comprises:

an interior side component, the interior side component having a surface, an interior side component hook extending outwardly from the surface of the interior side component and a flange extending outwardly from the surface of the interior side component and spaced from the interior side component hook, the flange of the interior side component defining an outrigger receiving slot on the interior side component;

an exterior side component situated opposite the interior side component, the exterior side component having a surface, an exterior side component hook extending outwardly from the surface of the exterior side component and an outrigger in the form of an elongated member extending outwardly from the surface of the exterior side component and spaced from the exterior side component hook;

an intermediate member situated between the interior side component and the exterior side component and extending a depth of the assembly of the window or the door, the intermediate member including:

an elongated body, the elongated body having a central support section comprising a single vertical wall, the single vertical wall of the central support section having a first side and a second side situated opposite the first side, each of the first side and the second side having a surface, the surface of the first side of the single vertical wall of the central support section of the intermediate member facing the surface of the exterior side component, the surface of the second side of the single vertical wall of the central support section of the intermediate member facing the surface of the interior side component;

a first hook extending outwardly directly from and being attached directly to the surface of the first side of the single vertical wall of the central support section, the first hook engaging the exterior side component hook;

a flange extending outwardly directly from and being attached directly to the surface of the first side of the single vertical wall of the central support section and spaced from the first hook, the flange defining an outrigger receiving slot, the outrigger of the exterior side component being at least partially received by the outrigger receiving slot of the flange of the intermediate member;

a second hook extending outwardly directly from and being attached directly to the surface of the second side of the single vertical wall of the central support section, the second hook engaging the interior component side hook; and an outrigger formed as an elongated member and extending outwardly directly from and being attached directly to the surface of the second side of the single vertical wall of the central support section and spaced from the second hook, the outrigger of the intermediate member being at least partially received by the outrigger receiving slot of the flange of the interior side component, wherein the first hook or the second hook of the intermediate member respectively defines with the surface of the exterior side component or the surface of the interior side component a space therebetween; and a locking component, the locking component being received in the space to prevent the disengagement of the first hook of the intermediate member and the exterior side component hook or the second hook of the intermediate member and the interior side component hook.

16. The assembly of a window or a door as defined by claim 15, wherein the locking component is removable from the space to allow disjoining of the interior side component and the intermediate member or the exterior side component and the intermediate member.

17. The assembly of a window or a door as defined by claim 15, wherein the outrigger of the intermediate member includes at least a first portion and a second portion, the first portion being joined directly to and extending outwardly directly from the surface of the second side of the single vertical wall of the central support section of the intermediate member, the first portion having an end, the second portion being joined to the end of the first portion and extending therefrom at an angle thereto.

18. The assembly of a window or a door as defined by claim 17, wherein the second portion of the outrigger of the intermediate member includes an end; and wherein the outrigger of the intermediate member includes a third portion, the third portion extending from the end of the second portion of the outrigger at an angle thereto.

19. The assembly of a window or a door as defined by claim 15, wherein each of the first hook and the second hook of the intermediate member includes a first portion, a second portion and a third portion, the first portion of the first hook extending outwardly directly from and being joined directly to the surface of the first side of the single vertical wall of the central support section of the intermediate member, the first portion of the second hook extending outwardly directly from and being joined directly to the surface of the second side of the single vertical wall of the central support section, each of the first portions of the first hook and the second hook having an end, each of the second portions of the first hook and the second hook extending from the end of the respective first portion of the first hook and the second hook and transversely thereto, each of the second portions of the first hook and the second hook having an end, each of the third portions of the first hook and the second hook extending from the end of the respective second portion of the first hook and the second hook and transversely thereto, the third portion of the first hook being spaced from the first portion of the first hook to define with the first portion of the first hook a first cooperating hook receiving slot, the third portion of the second hook being spaced from the first portion of the second hook to define with the first portion of the second hook a second cooperating hook receiving slot, the first cooperating hook receiving slot receiving at least a portion of the exterior side component hook of the exterior side component, the second cooperating hook receiving slot receiving at least a portion of the interior side component hook of the interior side component.

* * * * *